US007145062B2

(12) United States Patent
Ishida

(10) Patent No.: US 7,145,062 B2
(45) Date of Patent: Dec. 5, 2006

(54) STRING-STRIKING DEVICE OF PIANO

(75) Inventor: Muneo Ishida, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 6 days.

(21) Appl. No.: 10/512,631

(22) PCT Filed: Jan. 14, 2003

(86) PCT No.: PCT/JP03/00227

§ 371 (c)(1),
(2), (4) Date: Oct. 26, 2004

(87) PCT Pub. No.: WO2004/044885

PCT Pub. Date: May 27, 2004

(65) Prior Publication Data

US 2006/0060058 A1 Mar. 23, 2006

(30) Foreign Application Priority Data

Nov. 14, 2002 (JP) ..... 2002-330816

(51) Int. Cl.
*G10F 1/02* (2006.01)

(52) U.S. Cl. ..... 84/35; 84/236

(58) Field of Classification Search ..... 84/34–38, 84/105, 111, 167, 174, 236, 432, 433
See application file for complete search history.

(56) References Cited

U.S. PATENT DOCUMENTS 5,406,875 A * 4/1995 Tamai et al. ..... 84/433
5,594,188 A * 1/1997 Kawamura et al. ..... 84/171

FOREIGN PATENT DOCUMENTS

| | | | |
|---|---|---|---|
| DE | 3728841 | A | 5/1988 |
| JP | 51-99011 | A | 6/1976 |
| JP | 56-45887 | U | 4/1981 |
| JP | 57-31318 | Y2 | 7/1982 |
| JP | 59-16952 | Y2 | 5/1984 |
| JP | 63-70895 | | 3/1988 |
| JP | 1-47798 | B2 | 10/1989 |
| JP | 05-108059 | | 4/1993 |
| JP | 53-23219 | | 12/1993 |
| JP | 10-240257 | A | 9/1998 |
| JP | 3206048 | B2 | 7/2001 |

* cited by examiner

*Primary Examiner*—Lincoln Donovan
*Assistant Examiner*—Jianchun Qin
(74) *Attorney, Agent, or Firm*—Davis & Bujold, P.L.L.C.

(57) ABSTRACT

A string-striking device of a piano by which static loading applied to a front end of a key on the playing side can be readily adjusted. Each key (3) is provided with a long weight lever (21) disposed along the length direction of the key 3 at an upper part of the key (3) on the side opposite of the key to the playing side. The weight lever (21) is arranged such that one end thereof is fixed to a piano body so as to allow the weight lever (21) to freely swing up and down, and the other open end, which can be vertically displaced, is brought into contact with the upper surface of the key (3) and applies its own weight on the key (3). Thus, the static loading applied to the key (3) can be adjusted by replacing the weight lever (21) without disassembling the string-striking device and removing the key (3).

3 Claims, 6 Drawing Sheets

STRING-STRIKING DEVICE OF PIANO

TECHNICAL FIELD

This application is a national stage completion of PCT/JP03/00227 filed Jan. 14, 2003 which claims priority from Japanese Application Ser. No. 2002-330816 filed Nov. 14, 2002. This invention relates to a string-striking device of a piano which enables the adjustment of the static loading (force), applied upon the key operation, to a front end of a key on the playing side of the piano.

BACKGROUND ART

FIG. 6 is a side view of a string-striking device 100 of a piano, comprising a key 110, a transmitting portion 120, and a hammer portion 130. Conventionally as seen in FIG. 6, in order to adjust the static loading, applied upon the key 110 depression, to a front end 111 of the key 110 on the playing side, holes have been created on a side face 112 of the front end 111 of the key 110 on the playing side and leads 115, as plummets, have been buried therein. Additionally, for the impression of the sound of the key 110, the weight of the leads 115 has been adjusted so that the static loading of the key 110 is decreased gradually from the lower notes to the higher notes.

This static loading is sensed by a player of the piano as the touch and feel of the key 110. The static loading is an important parameter and how it is adjusted can determine whether the piano is considered good or bad. Thus, the static loading should be adjusted with caution in accordance with the skill and taste of the player.

In general, a string for a lower note is thicker than a string for a higher note. Therefore, a hammer 131 that strikes the string for a lower note is made larger and heavier than the hammer 131 for a higher note. Accordingly, the static loading for the lower note is heavier without the leads 115. Without the leads 115, however, especially in parts of the piano where two keys 110, residing next to each other, respectively have a different number of strings to strike, there is a problem in that the difference in the static loading between the two neighboring keys 110 becomes significantly large as compared to the case in other parts of the piano.

In the adjustment of the static loading, the weight of the leads 115 is selected to increase naturally within a reasonable range from the higher notes to the lower notes, taking into account such various factors. In this manner, the leads 115 are prepared for and attached to the respective keys 110 (see Japanese utility publication No. 53-23219, for example).

However, once the piano is assembled, adjustment of the static loading applied to the front end of the key on the playing side requires replacement of the leads 115, or replacement of both the leads 115 and the key 110. For this reason, the string-striking device 100 has to be disassembled. Accordingly, after the assembly of the piano, it is not easy to adjust the static loading according to the degree of improvement of a player's skill.

One object of the present invention is to provide a string-striking device of a piano which allows easy adjustment of the static loading applied to a front end of a key on the playing side.

DISCLOSURE OF THE INVENTION

In order to solve the above problem, a string-striking device of a piano, according to claim 1, is provided with a long weight lever, one for every key. The long weight lever is disposed along the length direction of the key above the side opposite to the playing side of the key of the piano. The weight lever is arranged such that one end thereof is fixed to a piano body so as to allow the weight lever to freely swing up and down. The other open end, which can be vertically displaced, is brought into contact with the key and applies its own weight to the upper surface of the key.

As above, since the weight lever applies a weight on the key, the static loading of the key can be adjusted by changing the weight of the weight lever. Moreover, since the weight lever is provided above the key, the weight of the weight lever can be readily changed. Thus, adjustment of the static loading of the key becomes easy, as compared to a conventional case of replacing the leads buried within the key.

In addition, if the present invention is applied to an upright piano, the touch and feel similar to that of a grand piano can be obtained. This is because the motion of the weight lever is similar to that of a hammer portion of the grand piano. Immediately after a player depresses a key, the corresponding weight lever moves in accordance with the motion of the key. When the player fully depresses the key and the motion of the key is stopped, the weight lever moves independently away from the key.

However, solely providing the weight lever above the key in the aforementioned manner may cause the player to feel uncomfortable. If the player strikes the key very hard, the weight lever jumps up high and then requires time to return to the position where the lever touches the key again. Therefore, as set forth in claim 2, it is preferable that the string-striking device is provided with a long stopper rail secured to the piano body and extending over a plurality of weight levers. The stopper rail restricts the upward swing of a plurality of weight levers.

With the stopper rail as above, appropriate adjustment of the time required for the weight lever to return to a state in which the lever touches the key again is possible by changing the set position of the stopper rail. Furthermore, a favorable touch and feel can be provided to the player.

Adjustment of the static loading can be conducted by changing the weight of the weight lever as mentioned above. However, as set forth in claim 3, the string-striking device may be further provided with a moving mechanism that moves the weight lever along the length direction of a key. The static loading may be adjusted by the moving mechanism moving the weight lever with respect to the key.

The reason why the adjustment of static loading is accomplished by the moving of the weight lever with respect to the key is that moving the weight lever results in a change in the distance between the point of application of the weight, applied by the weight lever to the key, and the fulcrum of the key (i.e. the position where the key touches an intermediate plate).

In this manner, adjustment of the static loading can be done without replacement of the weight lever, thus simplifying the task of adjusting the static loading.

On the other hand, depending upon the age, taste, etc. of the player, there may be a situation in which the temporary removal of the weight of the aforementioned static loading by the weight lever is desired. To readily meet this demand, it is preferable that the string-striking device is constituted as set forth in claim 4. That is, the string-striking device is provided with a long lifting rail that is disposed between the weight lever and the key and extends over a plurality of keys. The lifting rail is mounted to the piano body so as to be able to displace the weight levers by lifting the same from a normal position where the levers can touch the keys and a holding position where the levers are separated from the keys.

In the device constituted as above, if the lifting rail is raised so that the weight levers are lifted to the holding position where the levers do not touch the keys, a situation is created where the weight of the weight levers is no longer applied to the keys. Conversely, when the lifting rail is lowered so that the weight levers are also lowered to the normal position where the levers touch the keys, a situation is created where the weight of the weight levers is applied to the keys. In other words, a piano can be provided in which the static loading of the keys can be easily switched between two states, without detachment or replacement of the aforementioned weight levers.

The switching operation that raises and lowers the lifting rail may be conducted when an outer panel of the piano is removed. However, as set forth in claim 5, it is preferable that the string-striking device is provided with a connecting member, one end of which is connected to the lifting rail and the other end is brought out to the outside of the piano. The lifting rail can be displaced by operating the other end of the connecting member outside of the piano.

If the string-striking device is constituted as such, the player does not need to take off an outer panel of the piano in order to switch the position of the lifting rail (i.e. static loading applied to the keys). Thus, this configuration is convenient.

The weight lever may be rounded on the end part where the weight lever abuts on the key, for example. However, depending on the weight of the weight lever, there may be a situation in which excessive friction is produced between the weight lever and the key, thus affecting the touch and feel of the key. Therefore, in order to reduce the friction between the weight lever and the key, without changing the weight of the weight lever, the part of the weight lever which abuts on the key may be made in the form of a roller that can roll along the upper surface of the key, as set forth in claim 6.

Constituted as above, the friction between the contacting part of the weight lever and the key can be reduced. Moreover, wear of the contacting part can be prevented.

BEST MODE FOR CARRYING OUT THE INVENTION

Preferred embodiments of the present invention will be explained hereafter, by way of the accompanying drawings.

[First Embodiment]

Figure 1:
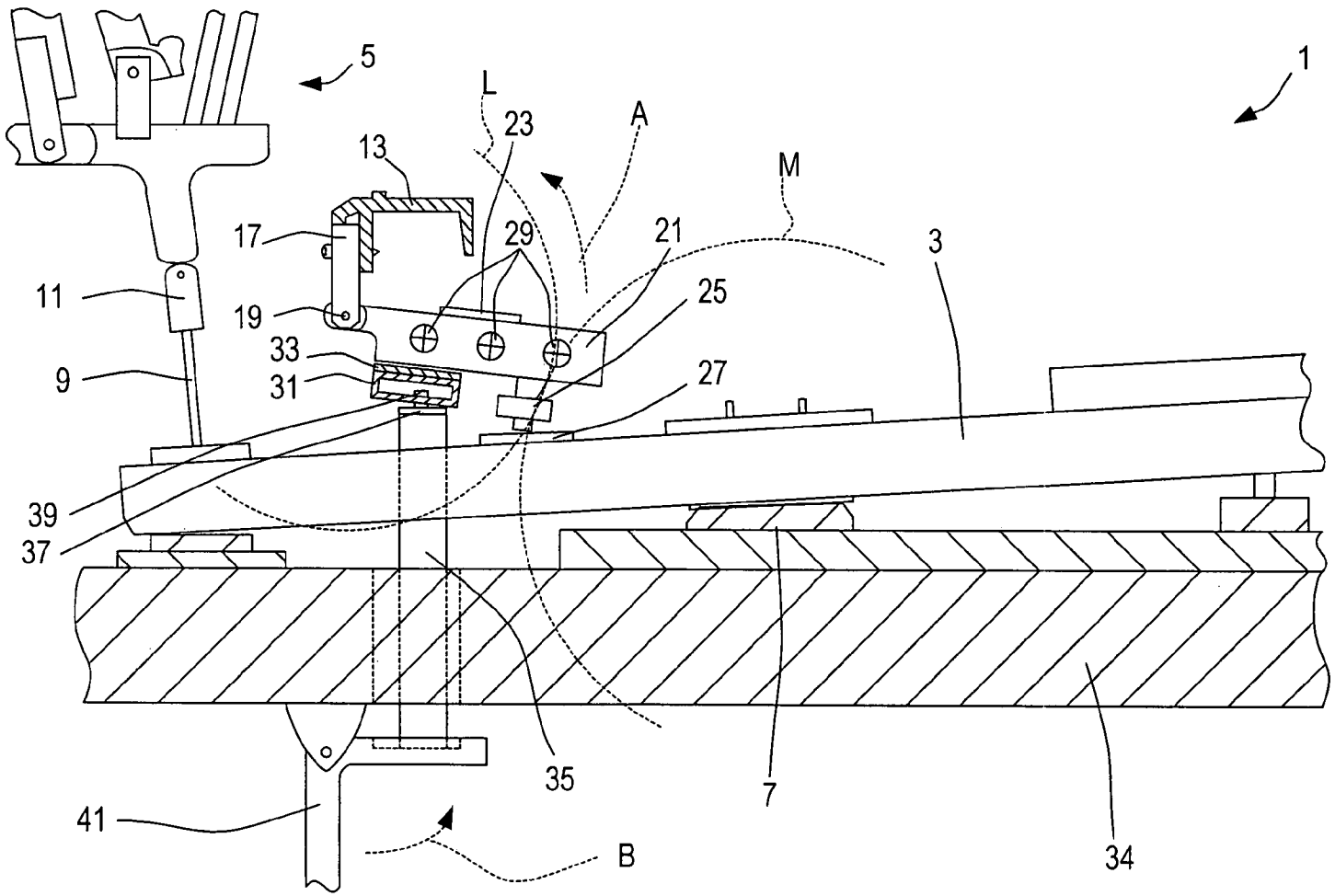
FIG. 1 is a side view showing a string-striking device of an upright piano according to a first embodiment.

FIG. 1 is a side view showing a string-striking device 1 of an upright piano. As shown in FIG. 1, the string-striking device 1 mainly comprises a key 3, a transmitting portion 5 (only a part of which is shown), and a hammer portion (not shown). The string-striking device 1 converts the motion of the key 3, resulting from the depression of the key by a player, to the motion of the hammer portion striking a string (not shown).

The piano has a total of 88 individual keys 3. Each key 3 is arranged to pivot on an intermediate plate 7 acting as a fulcrum. When a key 3 is depressed, the side opposite to the player side of the key 3 is raised to transmit the key depression to a transmitting portion 5. Particularly, the key depression is transmitted to the transmitting portion 5, and further to the hammer portion, via a capstan button 11 attached to an end of a capstan wire 9. The capstan wire 9 is provided at an end on the side opposite to the player side of the key 3. Hereinafter, the player side of the key 3 (left side in FIG. 1) is referred to as a front side, and the side opposite to the player side of the key 3 (right side in FIG. 1) is referred to as a rear side.

Above the rear side of the key 3, a long stopper rail 13 is provided which extends over a plurality of keys 3. Both ends of the stopper rail 13 are secured to the piano body by brackets 15 (not shown). Additionally, at the rear side of the stopper rail 13, a flange 17 is provided, one for every key 3, which is long in the vertical direction. The upper part of the flange 17 is fixed to the stopper rail 13 by screw. Furthermore, a weight lever 21 is rotatably attached to a rotation shaft 19 provided in the lower part of the flange 17. The weight lever 21 is arranged in parallel to the key 3 so that the rotation shaft 19 is at the rear side of the weight lever 21 and the front side of the weight lever 21 swings.

Felt 23 is provided on the upper surface of the weight lever 21 so as to absorb the undesirable sound generated when the weight lever 21 hits the stopper rail 13. On the other hand, at the front side of the under surface of the weight lever 21, a contacting part 25 is provided through which the weight lever 21 touches the key 3. Also on the upper surface of the key 3 where the weight lever 21 abuts the key 3 via the contacting part 25, felt 27 is provided to absorb the sound generated upon the abutment of the weight lever 21 and the key 3. Furthermore, lead plummets 29 used for adjusting the weight of the weight lever 21 are buried in a side face of the weight lever 21.

Below the rear side of the weight lever 21, a long hollowed lifting rail 31 is provided for lifting a plurality of weight levers 21.

Figure 2:
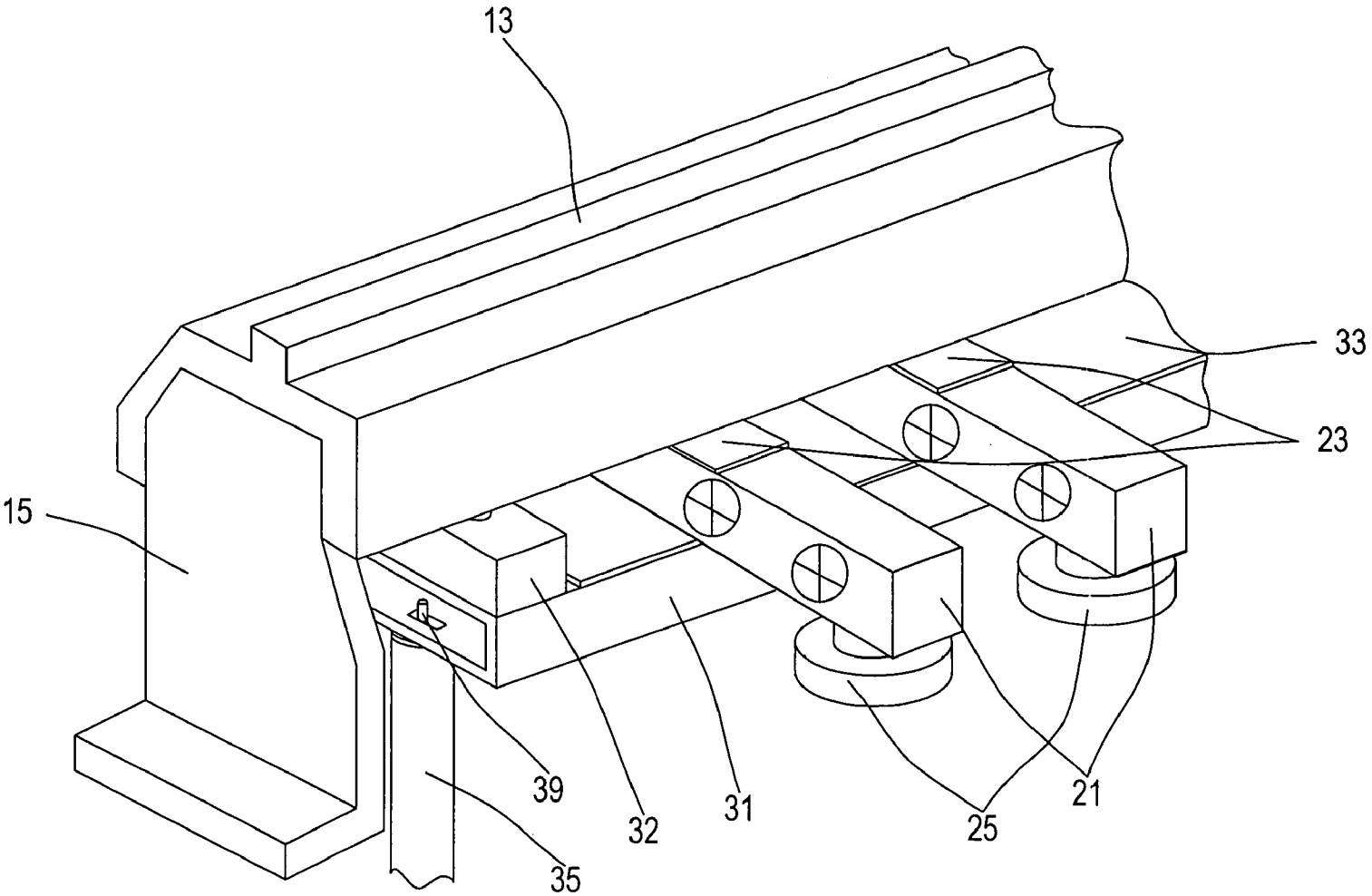
FIG. 2 is a perspective view showing the vicinity of a weight lever according to the first embodiment.

FIG. 2 is a perspective view showing the vicinity of the lifting rail 31. As shown in FIG. 2, the lifting rail 31 is secured at both ends and several intermediate portions by lifting levers 32 provided along the arrangement direction of the keys 3. Each lifting lever 32 is fixed rotatably to the stopper rail 13 via the flange 17 in substantially the same manner as the weight lever 21. Felt 33 is provided on the upper surface of the lifting rail 31 to absorb the shock caused when the lifting rail 31 hits the weight levers 21. Below one end of the lifting rail 31, a pushup stick 35 is provided which extends upward, penetrating the key bed 34.

The upper end of the pushup stick 35 is covered with a rubber cap 37 for easing the shock caused when the pushup stick 35 hits the lifting rail 31. In the center of the upper end of the pushup stick 35, a metal pin 39 is provided in the projected manner. On the side of the lifting rail 31, a guide hole (not shown) for the pin 39 is provided.

Returning to FIG. 1, at the lower end of the pushup stick 35, an L-shaped fitting 41 is provided which is capable of supporting the pushup stick 35 on one of the sides of the L. The L-shaped fitting 41 is designed to be rotated about its corner. The other side of the L-shaped fitting 41 is connected to a wire (not shown). At one end of the wire, a handle (not shown) is provided. This handle can be pulled to the front side and pushed to the rear side. The handle can be locked at the respective states by a locking device (not shown). The pushup stick 35, L-shaped fitting 41, wire, and handle, together correspond to a connecting member as set forth in the claims.

The string-striking device 1 constituted as such operates as below.

When a key 3 is depressed by a player, the rear side of the key 3 is raised. The capstan wire 9 provided at the end of the key 3, together with the capstan button 11 provided at the end of the capstan wire 9, is also raised to transmit the motion of the key 3 to the transmitting portion 5. Simultaneously, the key 3 raises the weight lever 21 via the contacting part 25. As a result, the weight lever 21 rotates in the direction of arrow A about the rotation shaft 19, until the weight lever 21 hits the stopper rail 13. Once the weight lever 21 hits the stopper rail 13, the weight lever 21 stops rotation, and then due to gravity, rotates in a direction opposite to arrow A about the rotation shaft 19 until the contacting part 25 abuts on the key 3.

Additionally, by pulling the aforementioned not-shown handle to the front side, the L-shaped fitting 41 rotates in the direction of arrow B to raise the pushup stick 35, causing the lifting rail 31 to move up and raise the weight levers 21. The result is that even if a key 3 is depressed, the key 3 does not contact the contacting part 25 of the weight lever 21.

To the contrary, by pushing the handle to the rear side, the L-shaped fitting 41 is rotated in a direction opposite to arrow B so as to lower the pushup stick 35, thus lowering the lifting rail 31 and the weight levers 21. The result is that the weight levers 21 are brought back into contact with the keys 3 and the weight levers 21 apply a weight on the keys 3. Hereinafter, the position of the lifting rail 31 in this state is referred to as the normal position.

In the string-striking device 1 constituted as above, the weight lever 21 can be easily replaced with another weight lever 21 either alone or together with the flange 17, without disassembling the whole string-striking device 1. Therefore, the static loading applied to the key 3 can be adjusted. Moreover, at the beginning of the depression of the key, the weight lever 21 applies a weight to the key 3. However, once the key 3 is fully depressed and the motion of the key 3 is stopped, the weight lever 21 may continue to move independently away from the key 3, until the weight lever 21 hits the stopper rail 13. Accordingly, since the motion of the weight lever 21 is similar to that of the hammer portion of a grand piano, a touch and feel close to that caused by the key depression of a grand piano can be obtained.

Moreover, by pulling the aforementioned not-shown handle, the lifting rail 31 in the normal position is raised to a holding position where the weight levers 21 do not touch the keys 3. A state is then created in which the weight of the weight levers 21 is not applied to the keys 3. Conversely, if the lifting rail 31 in the holding position is lowered to the normal position where the weight levers 21 are brought into contact with the keys 3, a state is created in which the weight of the weight levers 21 is applied to the keys 3. That is, without replacement of the weight levers, a piano can be provided in which the static loading applied to the keys 3 can be switched between two states. Moreover, raising and lowering the lifting rail 31 can be conducted by operation of a handle provided outside of the piano. Thus, removal of an outer panel of the piano is not necessary. This is convenient since the switching of the static loading applied to the keys 3 can be performed outside of the piano.

[Second Embodiment]

From now on, a second embodiment will be described. Hereinafter, mainly only the aspects that are different from the first embodiment are described.

Figure 3:
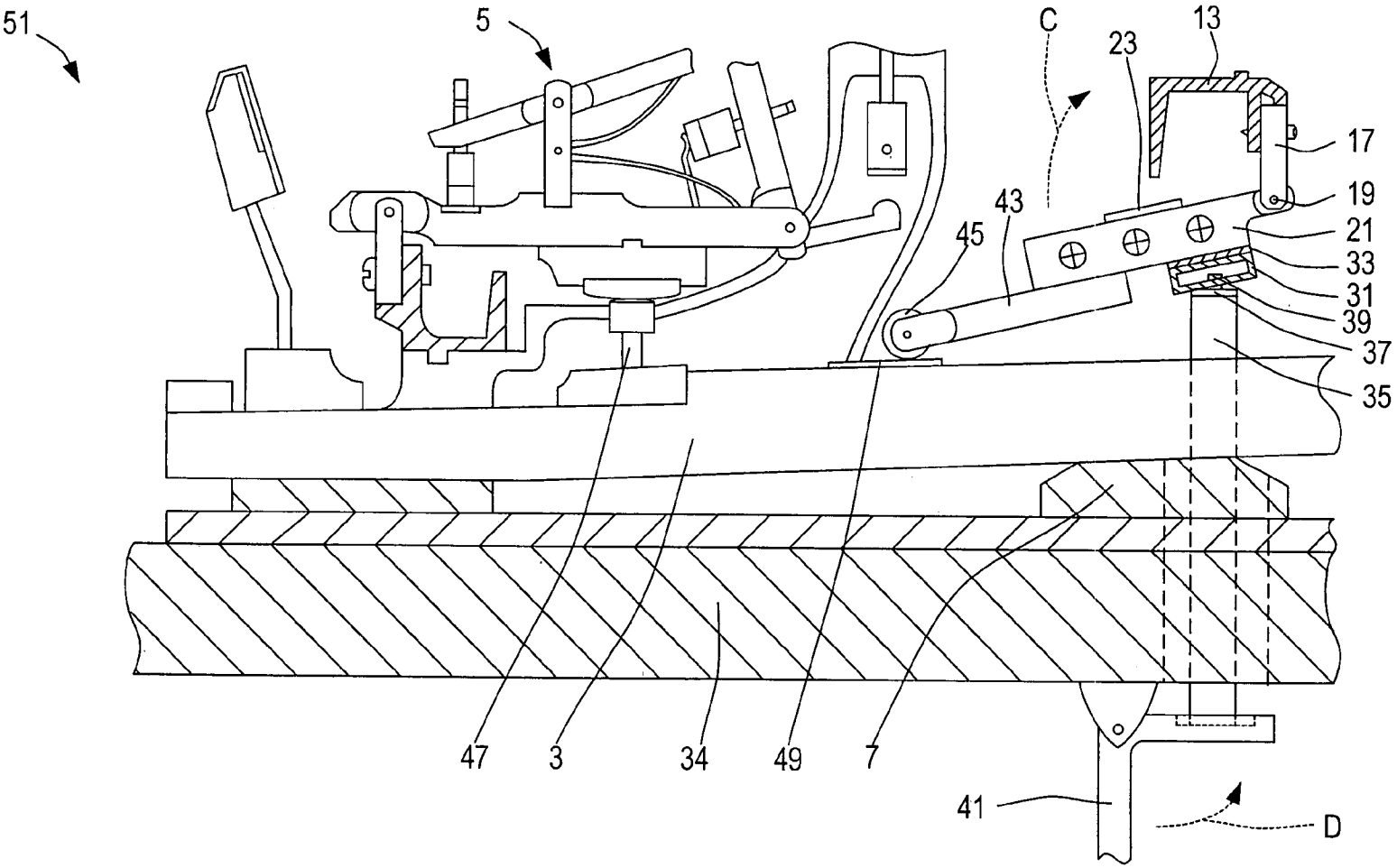
FIG. 3 is a side view showing a string-striking device of a grand piano according to a second embodiment.

FIG. 3 is a side view showing a string-striking device 51 of a grand piano. The same reference numbers are given to components identical to those in FIG. 1 and descriptions of those components are not repeated.

As shown in FIG. 3, the string-striking device 51 mainly comprises a key 3, a transmitting portion 5 (only a part is shown), and a hammer portion (not shown). The string-striking device 51 changes the motion of the key 3 resulting from the key depression by a player to the motion of the hammer portion striking a string (not shown).

A grand piano has a total of 88 individual keys 3. Each key 3 is arranged to pivot on an intermediate plate 7 acting as a fulcrum. When the front side (right side in FIG. 3) of this key 3 is depressed, the rear side (left side in FIG. 3) of the key 3 is raised so as to transmit the depression of the key to the transmitting portion 5. Particularly, the key depression is transmitted to the transmitting portion 5, and further to the hammer portion, via a capstan screw 47 provided at the rear side of the key 3.

A stopper rail 13 is secured to the piano body so as to be arranged above the intermediate plate 7. Moreover, a flange 17 is attached to the front side of the stopper rail 13. A weight lever 21 is attached rotatably to a rotation shaft 19 of the flange 17. In other words, the weight lever 21 is attached to the flange 17 such that the rear side of the weight lever 21 can swing.

Below the rear side of the weight lever 21, an extension rod 43 is provided extending further to the rear side. At the end of the extension rod 43, a roller 45 is provided to roll along the upper surface of the key 3. Felt 49 is arranged on the upper surface of the key 3 to reduce the sound produced upon the hitting of the roller 45 and the key 3.

Unlike the case of the first embodiment, a lifting rail 31 is provided below the front side of the weight levers 21. Moreover, a pushup stick 35 and an L-shaped fitting 41 are provided. A not shown wire is connected to one end of the L-shaped fitting 41, which is on the opposite side to where the pushup stick 35 is attached. Furthermore, a not shown handle is provided at the end of the wire.

The string-striking device 51 constituted as such operates as below.

When a key 3 is depressed by a player, the rear side of the key 3 is raised and the motion of the key 3 is transmitted to the transmitting portion 5 via the capstan screw 47. Simultaneously, the key 3 lifts up the weight lever 21, via the roller 45 and the extension rod 43. As a result, the weight lever 21 rotates in the direction of arrow C about the rotation shaft 19, until the weight lever 21 hits the stopper rail 13. Once the weight lever 21 hits the stopper rail 13, the weight lever 21 stops rotation, and then due to gravity, rotates in the direction opposite to arrow C about the rotation shaft 19, until the roller 45 abuts on the key 3.

Additionally, by pulling the aforementioned not-shown handle to the front side, the L-shaped fitting 41 rotates in the direction of arrow D so as to raise the pushup stick 35, causing the lifting rail 31 to rise up and raise the weight levers 21. The result is that even if a key 3 is depressed, the key 3 does not contact the roller 45.

To the contrary, by pushing the handle to the rear side, the L-shaped fitting 41 is rotated in the direction opposite to arrow D so as to lower the pushup stick 35, thus lowering the lifting rail 31 and the weight levers 21. The result is that the rollers 45 are brought into contact with the keys 3 so as to apply the weight of the weight levers 21 to the keys 3.

In the string-striking device 51 constituted as such, the same effects as in the first embodiment can be obtained. Below the rear side of the weight lever 21, an extension rod is provided extending toward the rear side. Therefore, even if the weight lever 21 is located close to the fulcrum of the key (the intermediate plate), the weight can still be effectively applied to the key 3. Moreover, a roller 45 is provided at the end of the extension rod 43, i.e. the portion where the extension rod 43 abuts the key 3. Therefore, regardless of the positional relationship between the rotation shaft 19 of the weight lever 21 and the center of rotation of the key 3 (i.e. the intermediate plate 7), the key 3 is smoothly operated. A favorable touch and feel can thereby be obtained.

[Third Embodiment]

Next, a third embodiment will be described. Hereinafter, mainly only the aspects that are different than the first embodiment are described.

Figure 4:
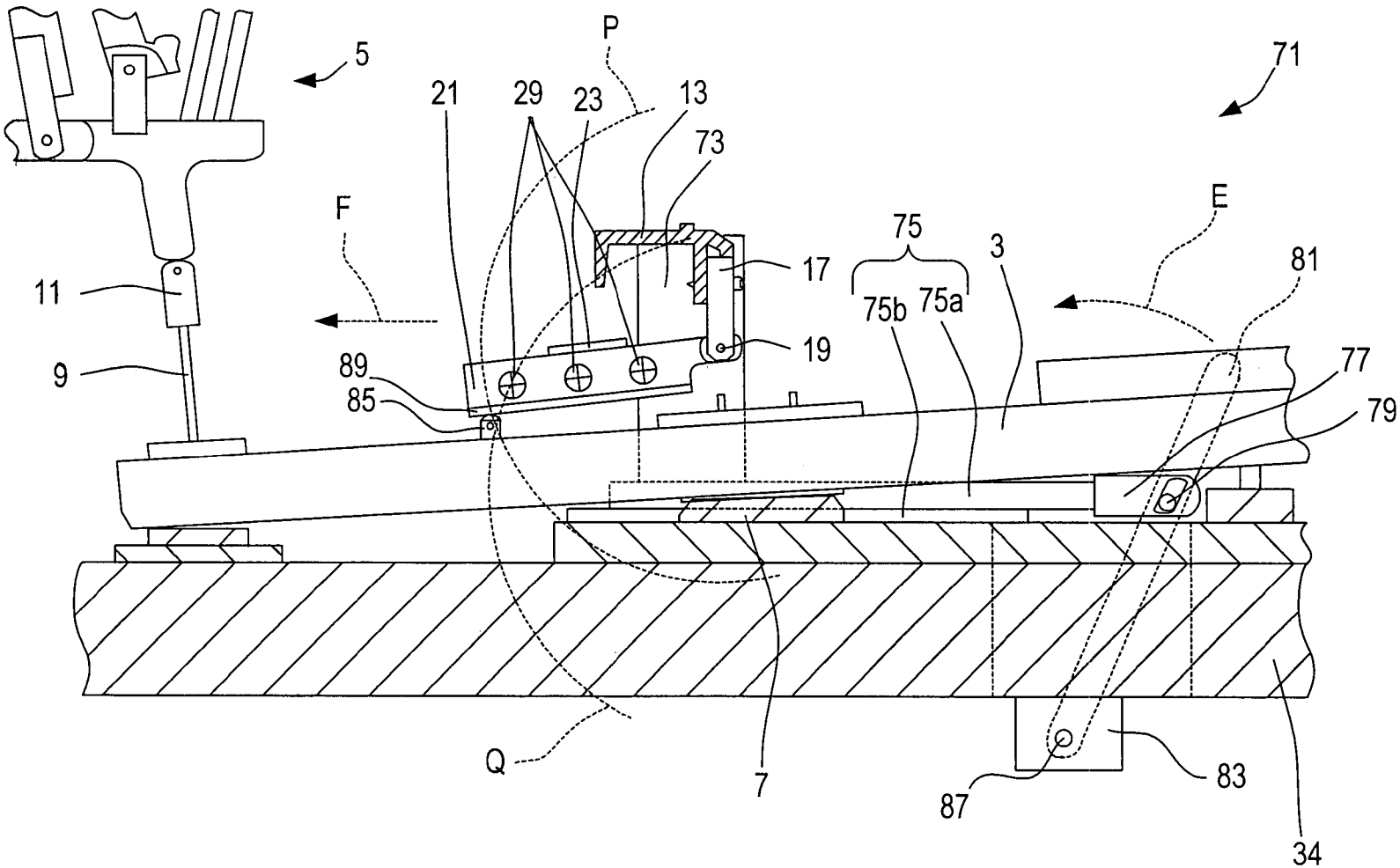
FIG. 4 is a side view showing a string-striking device of an upright piano according to a third embodiment.

FIG. 4 is a side view showing a string-striking device 71 of an upright piano. The same reference numbers are given to the components identical to those in FIG. 1. Therefore, the descriptions of the components are not repeated. As shown in FIG. 4, the weight lever 21 of the string-striking device 71 is different in its setting direction from the weight lever 21 of the string-striking device 1 of the first embodiment (see FIG. 1). The weight lever 21 of the string-striking device 71 is arranged to extend to the rear side (left side of FIG. 4) and swing about a rotation shaft 19. Additionally, the stopper rail 13 and others are disposed in accordance with the arrangement of the weight lever 21. In the first embodiment, the contacting part 25 (see FIG. 1) is provided on the under surface of the weight lever 21 of the string-striking device 1. However, on the under surface of the weight lever 21 of the third embodiment, felt 89 is provided for easing any potential hitting sound. The felt 89 may be replaced with cloth or rubber. Moreover, the weight lever 21 is designed to be supported by a lever receiving screw 85 provided on the upper surface of the key 3. The lever receiving screw 85 is arranged directly below the weight lever 21. The contacting part between the lever receiving screw 85 and the weight lever 21 is in a rounded form.

The stopper rail 13 is supported by board-like rail supporting members 73, provided at both ends and several intermediate positions (break portions) of the stopper rail 13. Additionally, the rail supporting members 73 are respectively fixed to upper rails 75*a* of the slide rails 75. A number of slide rails 75 provided as above are shaped similar to each other. Therefore, only one example is described in the following.

A slide rail 75 is disposed in parallel to a key 3, above the key bed 34 and below the aforementioned rail supporting member 73. The slide rail 75 is comprised of an upper rail 75*a* and a lower rail 75*b*. The lower rail 75*b* is fixed to the piano body. Moreover, between the lower rail 75*b* and the upper rail 75*a*, a bearing (not shown) is provided for reducing friction therebetweeen. The upper rail 75*a* is designed to slide freely between the rear side and the front side (right side of FIG. 4) on the lower rail 75*b*. Along with the sliding of the upper rail 75*a*, the rail supporting member 73, fixed to the upper rail 75*a*, also moves between the rear side and the front side. With this movement, the stopper rail 13, and flange 17, weight lever 21, etc. attached to the stopper rail 13, are also moved. Additionally, a flange 77 is provided at the front side end of the upper rail 75*a* of an outermost slide rail 75 among a plurality of slide rails 75. An arm pin 79, provided in the flange 77, releases force, other than the force given from a later-explained arm 81 in the sliding direction of the upper rail 75*a*, and allows the arm 81 and the upper rail 75*a* to work together.

The arm 81 is attached only to the upper rail 75*a* of the outermost slide rail 75 among the plurality of slide rails 75. In other words, there are two arms 81. One end of each arm 81 is attached to an attachment portion 83 provided on the under surface of the key bed 34 so as to be capable of being rotated about an attachment shaft 87. Thus, the two arms 81 work together via the attachment shaft 81. On the other hand, the other end of the arm 81 extends to the key 3, penetrating through the key bed 34. Additionally, one of the two arms 81 projects further to the outside of the piano, piercing though a case member, so that a player can operate the arm 81 without opening the piano.

The string-striking device 71 constituted as such operates as below.

When a player rotates the arm 81 in the direction of arrow E, the upper rail 75*a* slides to the rear side of the piano. Along with the sliding of the upper rail 75*a*, the rail supporting member 73, stopper rail 13, flange 17, and weight lever 21, are all moved to the rear side (in the direction of arrow F). Also, when the player rotates the arm 81 in the direction opposite to arrow E, the upper rail 75*a* slides to the front side of the piano. Along with this sliding of the upper rail 75*a*, the rail supporting member 73, stopper rail 13, flange 17, and weight lever 21, are all moved to the front side (in the direction opposite to arrow F).

In this manner, as the player operates the arm 81, the position of the weight lever 21, etc. can be changed. Along with the change of position, the operating point of the weight lever 21 is moved. As a result, successive adjustment of the static loading applied to the key 3 is possible.

Furthermore, since the two arms 81 are designed to work together, by operating only one of the arms 81, all the weight levers 21 can be moved uniformly.

Figure 5A:
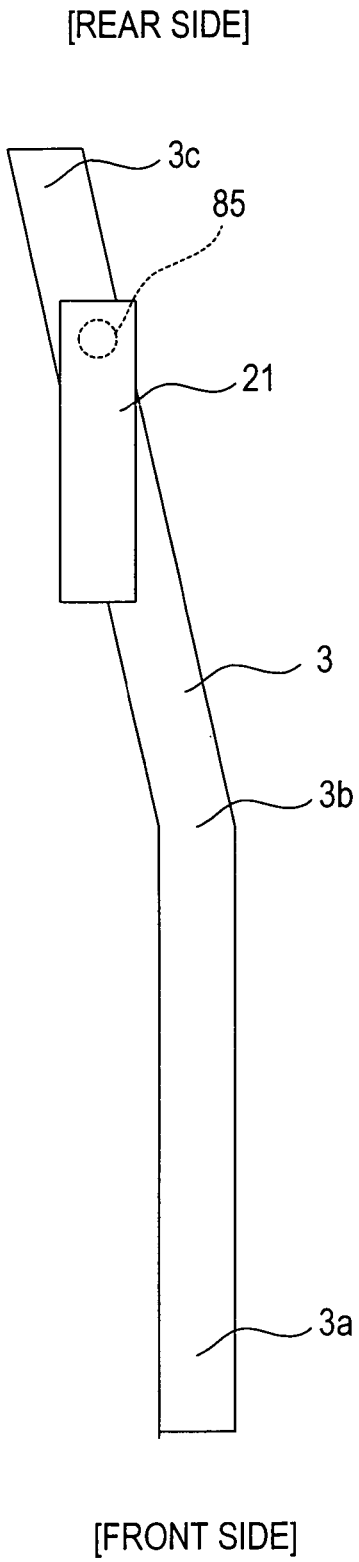
FIGS. 5A and 5B are overhead views of a key according to the third embodiment.
Figure 5B:
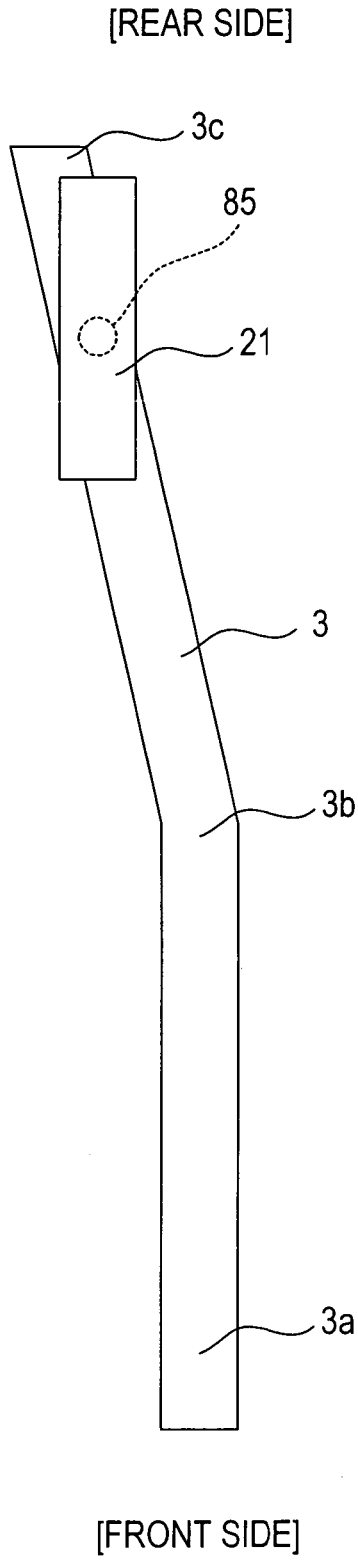
Figure 6:
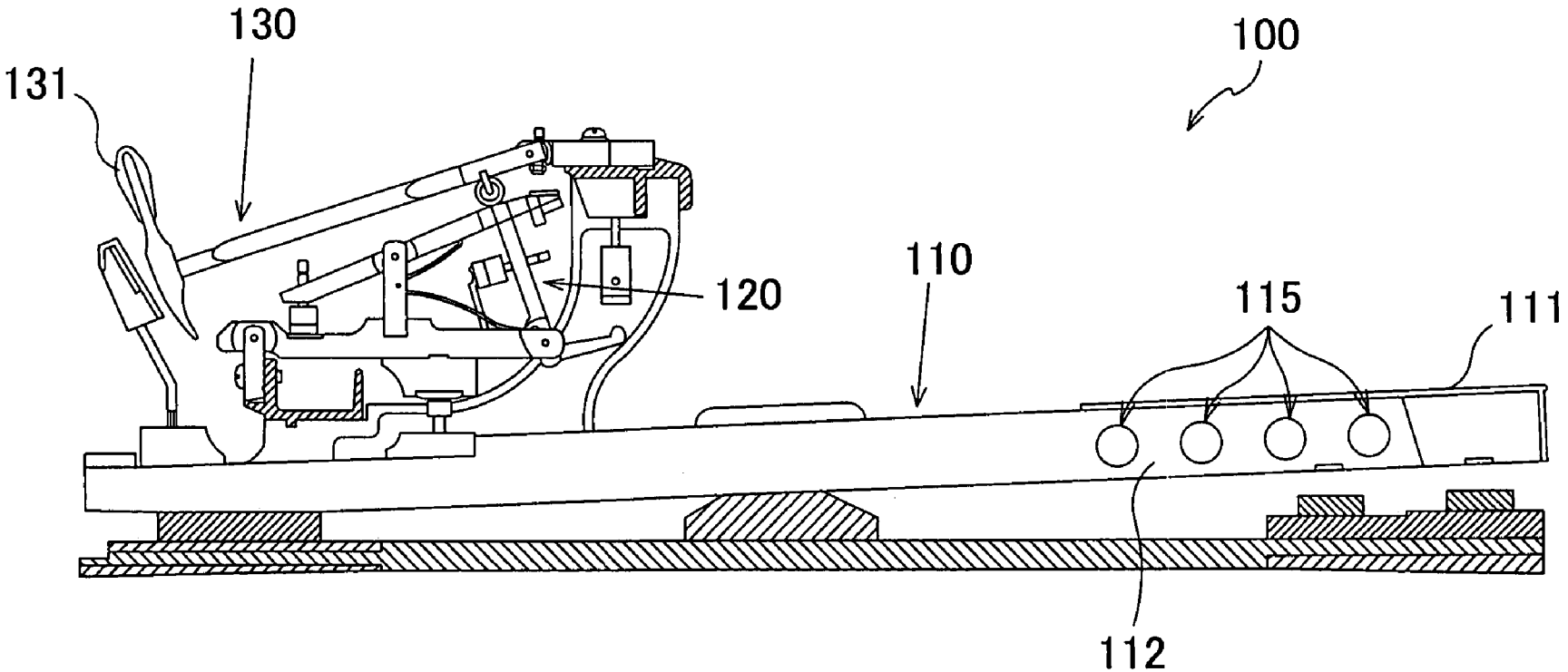
FIG. 6 is a side view showing a conventional string-striking device of a grand piano.

Next, the relationship between a weight lever 21 and a lever receiving screw 85 will be explained using drawing figures showing overhead views of the key 3. FIGS. 5A and 5B are drawings showing overhead views of one key 3, one weight lever 21, and one lever receiving screw 85, for a lower note. FIG. 5A is a drawing showing the case of the weight lever 21 arranged to the front side. FIG. 5B is a drawing showing the case of the weight lever 21 arranged to the rear side. The key 3 corresponds to a key 3 for a lower note and is thus bent at an intermediate part 3*b*. It should be noted that although not shown, a key 3 for a higher note is bent to the side opposite of the side shown in FIGS. 5A and 5B.

As can be seen in FIGS. 5A and 5B, if the weight lever 21 is moved in parallel to a playing portion 3*a* of the key 3, the weight lever 21 can be supported by the lever receiving screw 85. If the contacting part 25 was provided at the front end of the weight lever 21 on the swinging side of the weight lever 21, as in the string-striking device 1 of the first embodiment, the contacting part 25 would possibly move off of the upper surface of the key 3 upon the moving of the weight lever 21 in a direction parallel to the playing side of the key 3.

Therefore, the lever receiving screw 85 is provided to the key 3, as in the third embodiment, so that the weight lever 21 can be moved in parallel to the playing portion 3*a* of the key 3 and the weight lever 21 does not need to be moved parallel to the rear side portion 3*c* of the key 3. As a result, there is no need to provide a complicated mechanism which can make the weight levers 21 move in different directions depending on which side of the scale, i.e. the lower notes or the higher notes, the key 3 is located.

Moreover, the setting directions of the respective weight levers 21 in the third and first embodiments, that is, the sides of the weight lever 21 about which the weight levers 21 swing, are opposite. As a result, when the key 3 is depressed, a larger frictional force is generated between the weight lever 21 and the key 3 in the string-striking device 71 of the third embodiment as compared to the case of the string-striking device 1 of the first embodiment. The reasons for this will be explained in the following.

As shown in FIG. 1, upon depression of the key, the contacting part 25 of the weight lever 21 of the first embodiment moves along an arc L, and a part of the key 3 which abuts the contacting part 25 moves along an arc M. In this manner, the arc L and the arc M are nearly tangent to each other. Thus, in the vicinity of the tangent point of both arcs, there is not much difference in the track of motion between the contacting part 25 and the part of the key 3 which abuts the contacting part 25.

On the other hand, in the third embodiment as seen in FIG. 4, the lever receiving screw 85 moves along an arc Q and the part of the weight lever 21 which abuts the lever receiving screw 85 moves along an arc P. Accordingly, even in the vicinity of an intersection point of both arcs, there is large difference in the track of motion between the lever receiving screw 85 and the part of the weight lever 21 which abuts the lever receiving screw 85.

Therefore, a larger amount of friction is generated between the weight lever 21 and the key 3 (to be exact, the lever receiving screw 85) in the string-striking device 71 of the third embodiment as compared to the case in the string-striking device 1 of the first embodiment. Thus, by disposing the weight lever 21 as in the third embodiment, the static loading can be increased by much more than the weight of the weight lever 21.

In the above description, embodiments of the present invention were described. However, the present invention is not limited to the above embodiments, and other modifications and variations may be possible.

For example, a groove may be created on the under surface of the weight lever 21 of the first embodiment. The contacting part 25 may be designed to move in the front-side and rear-side directions with respect to the groove. In this manner as well, the operating point of the swing of the weight lever 21 can be adjusted, thus making possible the adjustment of the static loading of the key 3.

INDUSTRIAL AVAILABILITY

The present invention can provide a string-striking device of a piano which permits easy adjustment of static loading applied to a front end of a key on the playing side. Furthermore, the piano can provide a favorable touch and feel to the player.

The invention claimed is:

1. A string-striking device of a piano, the string-striking device comprising:

a long weight lever, one for every key, which is disposed along a length direction of the key at an upper part of the key on the side opposite to a playing side and which is arranged such that one end of the weight lever is fixed to a piano body so as to allow the weight lever to freely swing up and down, and the other open end, which can be vertically displaced, is brought into contact with the upper surface of the key and applies its own weight on the key; and the string-striking device further comprising a long lifting rail that is disposed between the weight lever and the key, so that the lifting rail extends over a plurality of keys and is fixed to the piano body in such a manner that, by lifting the weight levers, the lifting rail can displace the weight levers from a normal position, where the levers can touch the keys, to a holding position where the levers are spaced from the keys.

2. The stung-striking device of a piano according to claim 1, further comprising a connecting member, one end of which is connected to the lifting rail and the other end extends to an outside of the piano;

wherein the lifting rail can be displaced by operating the other end of the connecting member outside the piano.

3. A string-striking device of a piano, the string-striking device comprising:

a long weight lever, one for every key, which is disposed along a length direction of the key at an upper part of the key on the side opposite to a playing side and which is arranged such that one end of the weight lever is fixed to a piano body so as to allow the weight lever to freely swing up and down, and the other open end, which can be vertically displaced, is brought into contact with the upper surface of the key and applies its own weight on the key, wherein a part at which the weight lever touches the key is constituted by a roller that can roll along the upper surface of the key.

* * * * *